US006606056B2

(12) United States Patent
Brogden

(10) Patent No.: US 6,606,056 B2
(45) Date of Patent: Aug. 12, 2003

(54) BEAM STEERING CONTROLLER FOR A CURVED SURFACE PHASED ARRAY ANTENNA

(75) Inventor: Frank R. Brogden, Auburn, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 09/992,306

(22) Filed: Nov. 19, 2001

(65) Prior Publication Data

US 2003/0095066 A1 May 22, 2003

(51) Int. Cl.[7] ..... H01Q 3/26
(52) U.S. Cl. ..... 342/372
(58) Field of Search ..... 342/372, 373, 342/374, 377

(56) References Cited

U.S. PATENT DOCUMENTS

| | | | | |
|---|---|---|---|---|
| 3,646,558 A | | 2/1972 | Campanella | |
| 3,697,994 A | | 4/1984 | O'Daniel | |
| 4,445,119 A | | 4/1984 | Works | |
| 4,532,518 A | * | 7/1985 | Gaglione et al. | 342/372 |
| 4,688,045 A | | 8/1987 | Knudsen | |
| 4,980,691 A | * | 12/1990 | Rigg et al. | 342/372 |
| 5,008,680 A | | 4/1991 | Willey et al. | |
| 5,103,232 A | * | 4/1992 | Chang et al. | 342/372 |
| 5,339,086 A | | 8/1994 | DeLuca et al. | |
| 5,353,031 A | | 10/1994 | Rathi | |
| 5,463,656 A | | 10/1995 | Polivka et al. | |
| 5,512,906 A | | 4/1996 | Speciale | |
| 5,541,607 A | * | 7/1996 | Reinhardt | 342/372 |
| 5,543,805 A | | 8/1996 | Thanlyavarn | |
| 5,642,122 A | | 6/1997 | Lockie et al. | |
| 5,675,343 A | * | 10/1997 | Champeau | 342/372 |
| 5,751,248 A | | 5/1998 | Thanlyavarn | |
| 5,990,830 A | * | 11/1999 | Vail et al. | 342/377 |
| 6,205,224 B1 | | 3/2001 | Underbrink | |
| 6,333,712 B1 | | 12/2001 | Haugse et al. | |
| 6,351,247 B1 | | 2/2002 | Linstrom et al. | |
| 6,356,239 B1 | | 3/2002 | Carson | |
| 2002/0070898 A1 | * | 6/2002 | Vail et al. | 342/374 |
| 2002/0084934 A1 | * | 7/2002 | Vail et al. | 342/372 |

FOREIGN PATENT DOCUMENTS

EP 0 923 154 A2 11/1998

OTHER PUBLICATIONS

Sparse antenna arrays properties investigation in radioimage forming systems, I Prudyus et al., Proceedings of the Internationa Conference on Modern Problems of Radio Engineering, Telecommunications and Computer Science, p. 226–227, 2002.*

* cited by examiner

*Primary Examiner*—Thomas H. Tarcza
*Assistant Examiner*—F H Mull
(74) *Attorney, Agent, or Firm*—Harness Dickey & Pierce P.L.C.

(57) ABSTRACT

An advanced external beam steering controller (AEBSC) for use with a phased array antenna which requires only spherical coordinate pointing information to be supplied from a remote controller. The AEBSC uses the spherical coordinate pointing information, as well as stored information for the X, Y and Z axes locations of each specific antenna element of the phased array antenna, to generate actual phase shift values needed to be applied to each antenna element in order to point the antenna in accordance with a predetermined pointing angle. The invention significantly reduces the amount of electrical cabling required for communicating with the external controller, and also reduces the required data rate at which information must be supplied from the remote controller to the AEBSC.

10 Claims, 2 Drawing Sheets

BEAM STEERING CONTROLLER FOR A CURVED SURFACE PHASED ARRAY ANTENNA

FIELD OF THE INVENTION

This invention relates to phased array antennas, and more particularly to a beam steering controller used with a phased array antenna. The beam steering controller calculates the necessary phase shift data for each of the antenna elements of the antenna needed to point the antenna in a desired pointing direction while requiring a significantly lesser amount of data to be supplied thereto from an independent controller system disposed remotely from the antenna.

BACKGROUND OF THE INVENTION

Previously developed phased array antenna beam steering controller designs have relied on antenna elements (i.e., "modules") spaced at regular X and Y intervals in the antenna. Phase shift data is calculated for each element based on a constant delta phase shift in the X and Y directions (from row to row and column to column). Also, previous designs of phased array antennas have required each phase shift value for each antenna element of the antenna to be transmitted over a cable from an internal controller in the vehicle (such as an aircraft) to the external beam steering antenna. For a 1500 element phased array antenna, six twisted pairs of conductors (100 foot cable, 5 Mbit/sec RS-422) have been required to transmit the phase data from the internal controller within the vehicle to the external beam steering controller of the antenna to support a one millisecond beam update rate. The existing external beam steering controller used with present day phased array antennas decodes messages from the internal controller and serially loads phase shift data into each element in the antenna through a matrix of rows and columns of data and clock signal lines.

Accordingly, it would be highly desirable to provide a phased array antenna having an external beam steering controller which is capable of generating the needed phase shift data for each element of the antenna without requiring the heretofore very large amounts of phase shift data to be supplied from the internal controller disposed remotely from the antenna. More specifically, it would be highly desirable to provide an external beam steering controller which is capable of determining the needed phase shift values to be applied to each antenna element from just the spherical pointing information representing the desired pointing angle of the antenna. Such a beam steering controller would dramatically reduce the amount of electrical cabling required to supply the phase shift data to each antenna element of a phased array antenna incorporating hundreds or thousands of independent antenna elements. This would dramatically reduce the number of bits of information required to be sent from the remote (i.e., internal) controller to the external beam steering controller. Also, this capability would permit the data to be transmitted at a fraction of the data rate that would otherwise be required if all of the needed phase shift data was being supplied from the remote controller.

SUMMARY OF THE INVENTION

The above and other objects are provided by an advanced external beam steering controller and method for use with a phased array antenna, in accordance with preferred embodiments of the present invention. In one preferred form the external beam steering controller incorporates a memory for storing X, Y and Z access antenna element geometry information representative of the location of each antenna element in X, Y and Z coordinates, relative to a pre-determined center of the antenna. The advanced external beam steering controller (AEBSC) is also in communication with the remote (i.e., internal) controller and receives information from the remote controller which contains the X, Y and Z axis phase gradients for a desired pointing angle of the antenna. The AEBSC uses the phase gradient information and the element geometry information stored in its memory to calculate the individual element phase shift values required to point the antenna in accordance with the desired pointing angle.

It is a particular advantage of the present invention that the antenna element geometry information is unique to the antenna and can represent antenna elements located at random (i.e., non-uniform) X, Y and Z locations. Put differently, the independent antenna elements can be arranged in patterns which deviate from the typical X, Y uniform grid arrangement. Thus, the antenna element geometry information allows for a plurality of antenna elements to be arranged to form square, circular or other antenna shapes. Furthermore, the antenna elements do not need to be positioned in the traditional X-Y grid, with the rows of elements being parallel to one another and the rows and columns intersecting in perpendicular fashion. Since the precise location of each antenna element, relative to the center of the antenna, is stored in the memory of the AEBSC, positioning of the elements in virtually any non-uniform configuration is permitted.

In one preferred form of the invention, the AEBSC receives spherical coordinate pointing information from the remote controller. This information comprises values representing the fraction of a wavelength of phase shift per wave length of displacement of a given antenna element along each of the X, Y and Z axes of the antenna. These values are transmitted as 16 bit, signed 2's complement binary values with the least significant bit (LSB) representing $2^{-10}$ of a wavelength at the center operating frequency of the antenna. Such binary values require a minimum of 10 bits to the right of the binary point. A sign bit and 5 non-fractional bits are preferably provided to the left of the binary point to support scaling the DX, DY and DZ fractional wavelength phase shift values up or down to support other frequency bands (i.e., frequency bands different than the antenna center frequency). This dynamic range and precision supports an antenna with dimensions of greater than 32 wavelengths in the X and Y directions.

The AEBSC then calculates the phase for each element of the antenna from the stored element geometry information and the pointing information provided by the remote controller to determine an element delay value representing the delay in wavelengths required for the signal from a given antenna element to the antenna center, in order to sum in-phase with signals from the other antenna element. The AEBSC then determines an element phase shift value for each antenna element by rounding the element delay to a given number of bits and then truncating that number to one wavelength.

The present invention thus allows phase shift values to be calculated by the AEBSC and supplied to a large plurality of antenna elements, while supplying only the spherical coordinate pointing information from the remote controller. This dramatically reduces the amount of electrical cabling required for the antenna, as well as reducing the required data rate at which the information from the remote controller needs to be supplied to the AEBSC.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
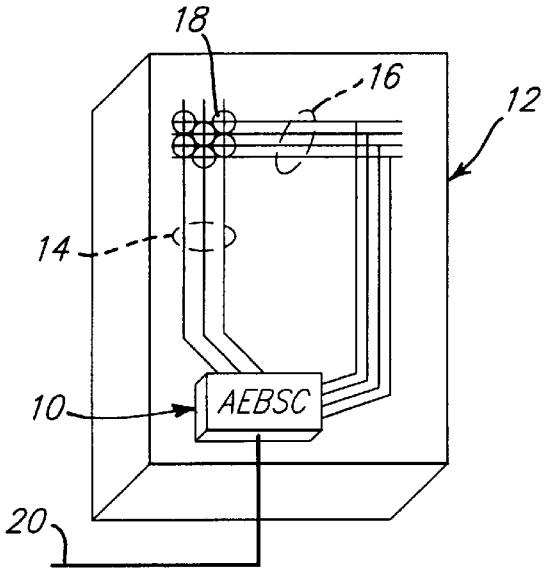
FIG. 1 is a highly simplified drawing of a phased array antenna illustrating the clock and data lines coupling each of the antenna elements of a phased array antenna to an advanced external beam steering controller (AEBSC) of the present invention.

Referring to FIG. 1, there is shown a highly simplified illustration of a phased array antenna 12 incorporating an advanced beam steering controller (AEBSC) 10 of the present invention. The antenna 12 has a plurality of clock lines 14 and a plurality of data lines 16. Each clock line 14 and each data line 16 intersect (i.e., couple to) each one of a plurality of antenna elements 18 (i.e., modules) which form the antenna. The AEBSC 10 is provides the clock and data signals to each antenna element 18. The AEBSC 10 receives information from a remote (i.e., "internal") controller (not shown) which is typically located inside the vehicle on which the antenna 12 is mounted, via a suitable control cable 20. In one preferred implementation, the control cable 20 comprises a RS-485 control cable.

Figure 2:
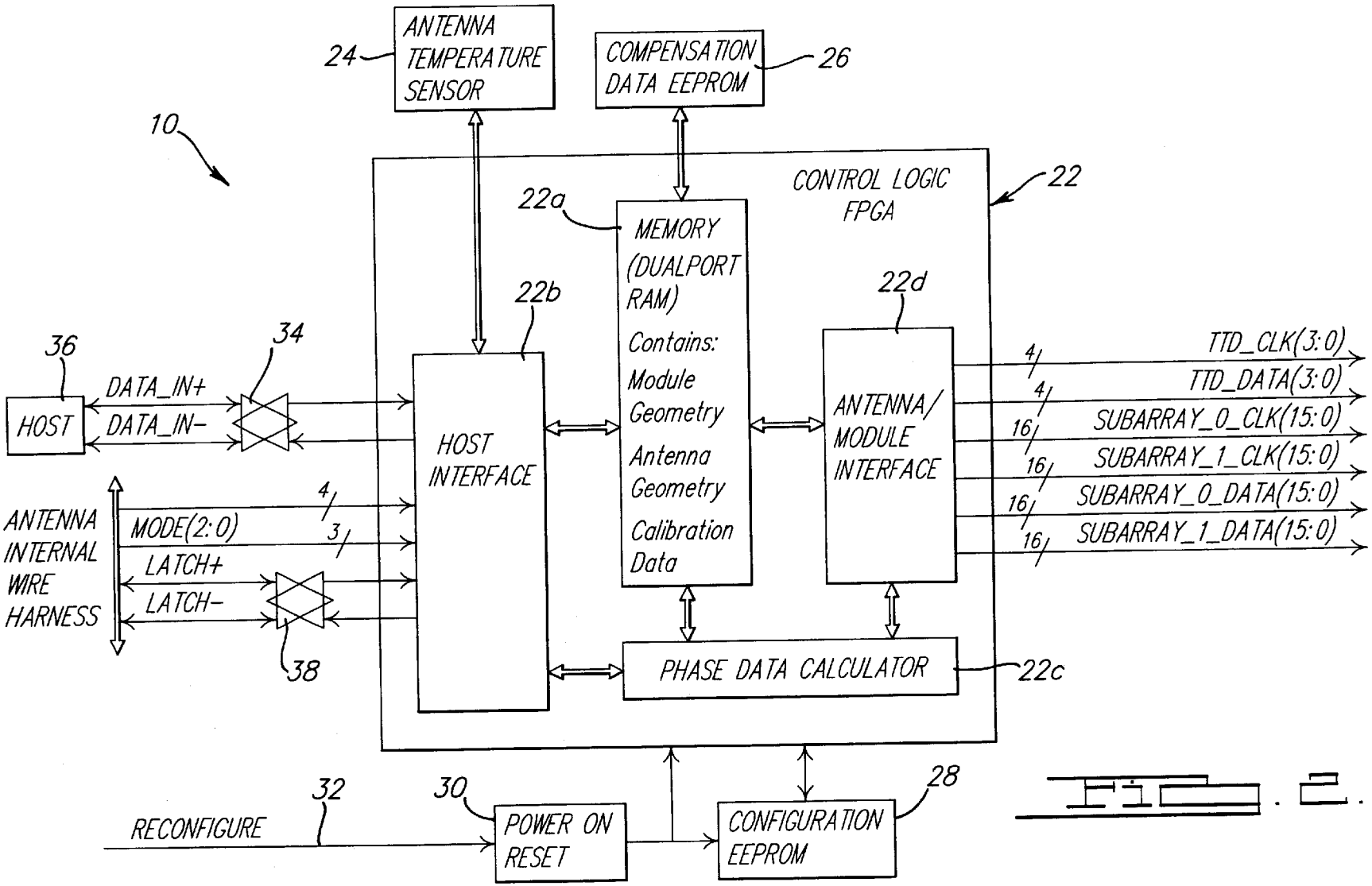
FIG. 2 is a simplified functional block diagram of the AEBSC.

Referring to FIG. 2, the AEBSC 10 is shown in greater detail. The AEBSC 10 includes a control logic circuit in the form of a field programmable gate array (FPGA) 22 which is in communication with a compensation data EEPROM 24, an antenna temperature sensor 26 and a configuration EEPROM 28. A power-on reset circuit 30 is also supplied for allowing a reset signal via line 32 to be used to reset the AEBSC 10. A host RS-485 interface 34 forms a transceiver for providing a bi-directional differential interface to a host controller 36 (which does not form a part of the AEBSC 10). A latch interface transceiver 38 allows a discrete latch signal to be generated or received by the AEBSC 10. After the AEBSC 10 has calculated phase shift data and loaded the data into each antenna element's 18 input shift register, the latch signal is used to synchronize the transfer of the phase shift data from the antenna element's shift registers to the element's phase shifter, thus "instantaneously" updating the pointing angle for the phased array antenna 12.

With further reference to FIG. 2, the compensation data EEPROM 24 contains antenna-specific calibration and geometry (element X, Y and Z) offset data. This calibration and geometry data is downloaded to the FPGA 22 where it is held in a dual port RAM 22*a*. The dual port RAM 22*a* is in communication with a host interface circuit 22*b*, a phase data calculator 22*c* and an antenna/module interface circuit 22*d*. This data is used to calculate individual phase values for each antenna element 18, based on the desired pointing angle, as commanded by the host 36. The configuration EEPROM 28 contains the RAM-based FPGA 22 gate level layout bit map. This bit map is automatically downloaded into the FPGA 22 at power up reset. The antenna temperature sensor 26 is a digital temperature sensor and is controlled and interrogated by the FPGA 22. The antenna temperature sensor 26 allows the host controller 36 to monitor the temperature of the antenna 12.

Figure 3:
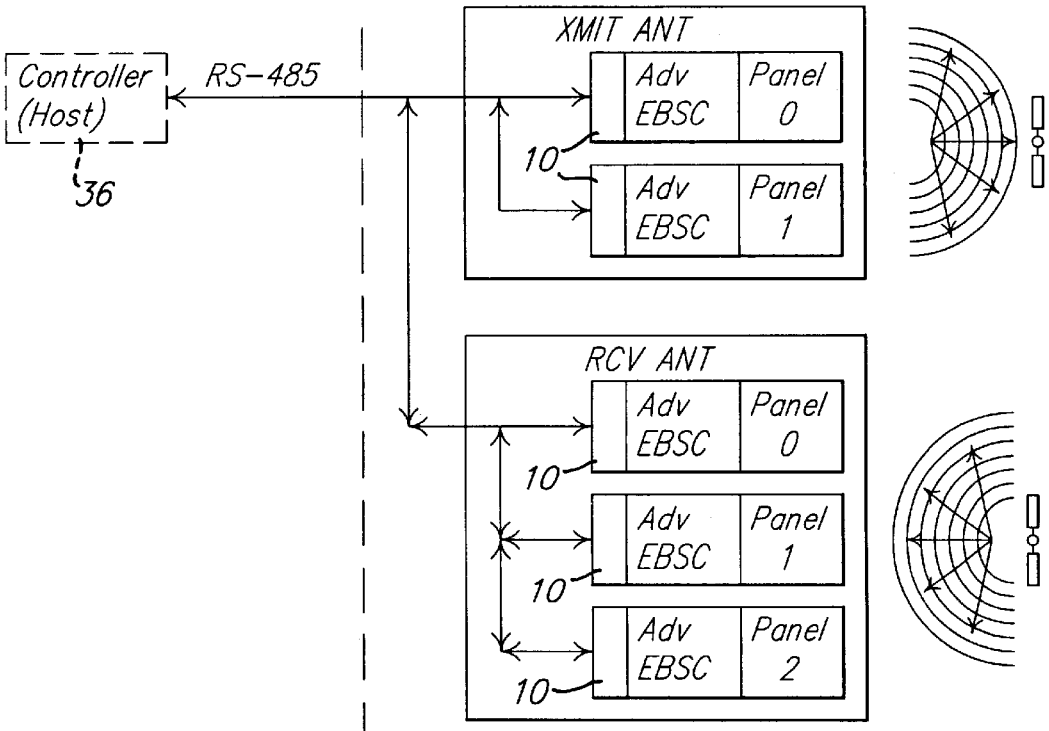
FIG. 3 is a simplified block diagram showing a plurality of AEBSCs being used to control a pair of antenna panels of a transmit phased array antenna, and a plurality of three panels of a receive phased array antenna, and further illustrating the transmit and receive antennas in communication with an internal (i.e., remote) controller within a vehicle.

It will be appreciated that the exemplary AEBSC 10 illustrated in FIG. 2 is shown providing clock and data lines for handling two subarrays of the antenna 12. However, it will be appreciated that a single subarray could also be controlled by the FPGA 22. Alternatively, a plurality of AEBSCs 10 could be incorporated to control multiple antenna panels via suitable busses, as illustrated in FIG. 3.

Turning now to the operation of the AEBSC 10, it will be appreciated that it is a principal advantage of the present invention that only spherical coordinate pointing information needs to be transmitted from the host (i.e., "remote" or "internal") controller 36 to the AEBSC 10. This dramatically reduces the amount of electrical cabling required with prior art systems which rely on providing the actual phase shift values from the host controller 36 to a phased array antenna. Due to this reduction in the amount of data that is required to be sent, the needed data from the host controller 36 can be transmitted over one twisted pair cable to the AEBSC 10. Moreover, due to the reduction of the number of bits of data being sent, the information can be supplied at a much lower data rate than is required with present day beam steering controllers. With the AEBSC 10, the data rate at which data is required to be transmitted from the host 36 can be reduced to approximately $1/10^{th}$ of the data rate required with present day beam steering controllers, and the number of elements 18 in the antenna 12 has no effect on the required data rate.

Figure 4:
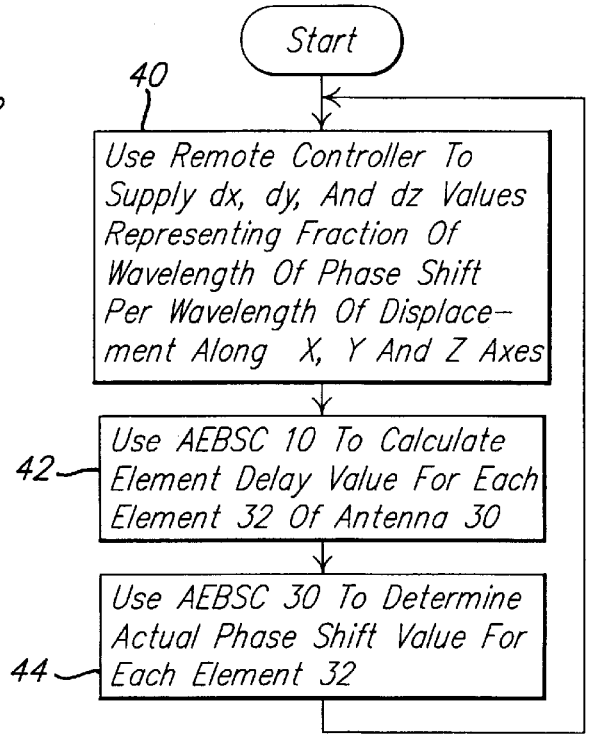
FIG. 4 is a flowchart illustrating the steps of operation executed by the AEBSC in determining the actual phase shift values needed to be applied to each of the antenna elements of a phased array antenna.

Turning to FIG. 4, a flow chart is shown illustrating the steps performed by the AEBSC 10. Initially, the host controller 36 supplies only spherical coordinate pointing information to the AEBSC. This is done by using the host controller 36 to calculate the sine and co-sine of the elevation angle (θ) and the azimuth angle (Φ) and transmitting these value to the AEBSC 10. These values are represented as follows:

$$dx=\sin(\theta)*\cos(\Phi)$$

$$dy=\sin(\theta)*\sin(\Phi)$$

$$dz=\cos(\theta)$$

This operation is represented by step 40. The dx, Dy and dz values represent the fraction of a wavelength of phase shift per wavelength of displacement along each of the X, Y and Z axes of the antenna 12. In the preferred embodiment, these values are transmitted as 16 bit signed 2's complement binary values with the least significant bit (LSB) representing $2^{-10}$ of a wavelength at the center operating frequency of the antenna. This requires a minimum of 10 bits to the right of the binary point. Also, a sign bit (the MSB) and 5 non-fractional bits are provided to the left of the binary point to support scaling the dx, dy and dz values up or down to support other frequency bands (i.e., different than the center frequency of the antenna 12). This dynamic range and precision supports an antenna with dimensions of greater than 32 wavelengths in the X and Y directions. Accordingly, the pointing information sent to the AEBSC 10 essentially consists of three 16-bit values.

Next the AEBSC 10 is used to calculate delay values for each element 18 of the antenna 12, as indicated at step 42. This is performed in accordance with the following formula:

$$\text{Element_Delay}=dx*\Delta X+dy*\Delta Y+dz*\Delta Z$$

where ΔX, ΔY and ΔZ are the X, Y and Z displacements (in wavelengths) of each element 18 from a predefined center of the antenna 12. Next, as indicated at step 44, the AEBSC 10 is used to determine the actual phase shift values to be applied to each of the antenna elements 18. This is performed in accordance with the following formula:

Element_Phase_Shift=Trunicate_to_1_wavelength (Round_to_4_bits (Element_Delay))

where Element_Delay is the 2's complement signed delay in wavelengths required for the signal from a given antenna element to the predetermined center of the antenna 12, in order to sum in-phase with signals from other antenna elements 18, and where Element_Phase_Shift is the actual phase shift value, in modulo 1 wavelength, loaded into each antenna element 18. The Element_Phase_Shift value is also truncated such that only the 4 bits to the right of the binary point are kept. This provides a precision of $2^{-4}$ (i.e., 1/16) wavelengths for the actual phase shift values.

The actual phase shift values determined at step 44 use 4 bit precision, and are applied to each antenna element 18.

An important advantage of the AEBSC 10 is that the antenna elements 18 may be placed at non-uniform X, Y and Z locations such that the overall shape of the element grouping is arbitrary. Put differently, the elements 18 do not have to be arranged in a rectangular X-Y grid arrangement. Rather, the present invention can accommodate non-uniform element placement to form virtually any desired shape of antenna.

The ΔX, ΔY and ΔZ locations for each antenna element 18 form part of the antenna configuration and compensation data which is stored in the configuration EEPROM 28 of the AEBSC 10. This data is stored in an array with each location corresponding to a clock line 14 and data line 16 intersection for a given antenna element 18. The clock lines 14 and data lines 16 do not have to be arranged in perpendicular fashion to each other, and the element locations do not have to be in any regular pattern. If no antenna element 18 is located at a particular clock and data line intersection, then the phase data calculated for that element will be ignored. The particular clock line 14 and data line 16 connected to a given antenna element 18 has no effect on the phase shift value calculated for that element. The calculated phase shift value is based solely on the stored ΔX, ΔY and ΔZ locations of the given antenna element 18 and the input dZ, dY and dX pointing information supplied by the remote controller.

The AEBSC 10 of the present invention thus requires only the spherical coordinate pointing information from the remote controller 26, thereby eliminating a large degree of electrical cabling that would otherwise be necessary with prior developed phased array antenna systems. It also allows data to be transmitted from the host controller at a significantly reduced data rate, as compared with pre-existing beam steering controller designs.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A method for providing phase shift data to a phased array antenna having a plurality of antenna elements in a manner which reduces the amount of information needed to electronically steer said antenna, said method comprising:

using a host controller to provide X, Y and Z phase gradients for a desired pointing angle of said antenna;

using an external beam steering controller associated with said antenna to receive said X, Y and Z phase gradients and to combine said X, Y and Z phase gradients with element geometry information indicative of positions of each of said antenna elements, said element geometry information being programmed into said external beam steering controller; and using said beam steering controller to calculate individual antenna element phase shift values for each one of said antenna elements required to point said antenna in accordance with said desired pointing angle;

wherein said antenna elements are non-uniformly spaced in the X, Y and Z dimensions.

2. The method of claim 1, wherein said element geometry information is stored in a memory of said external beam controller.

3. The method of claim 1, wherein said element geometry information is unique to said phased array antenna and specifies a location, in X, Y and Z coordinates, of each said antenna element of said phased array antenna.

4. A method for providing phase shift data to a phased array antenna having a plurality of antenna elements in a manner which reduces the amount of information needed to electronically steer a beam of said antenna, said method comprising:

a) storing element geometry information in a memory of a beam steering controller associated with said antenna, wherein said element geometry information indicates a precise position of each said antenna element of said antenna in X, Y and Z coordinates, relative to a predefined center of said antenna;

b) supplying X, Y and Z axis phase gradients from a system external to said antenna to said beam steering controller, said X, Y and Z phase gradients representing a desired pointing angle for said antenna; and c) using said beam steering controller to calculate a phase shift value for each one of said antenna elements, from said X, Y and Z phase gradients and said stored element geometry information, that is required to point said antenna in accordance with said desired pointing angle.

5. The method of claim 4, wherein said antenna element geometry information permits placement of said antenna elements in non-uniform rows, columns and heights above or below said predefined center of said antenna.

6. The method of claim 5, wherein step c) comprises using said beam steering controller to calculate an element delay value for each said antenna element, based upon the position of each said antenna element relative to said center of said antenna and the cosine and sine values of each of an elevation angle and an azimuth angle, wherein said elevation and azimuth angles define said pointing angle.

7. The method of claim 6, wherein step c) further comprises using said beam steering controller to calculate, from said element delay values, said phase shift value for each one of said antenna elements needed to point said antenna in accordance with said desired pointing angle.

8. A method for providing phase shift data to a phased array antenna having a plurality of antenna elements in a manner which reduces the amount of information needed to electronically steer a beam of said antenna, said method comprising:

a) calculating fractional phase shift values each representing a fraction of a wavelength of phase shift per wavelength of displacement of each said antenna element, relative to a center of said antenna, along each of X, Y and Z axes of the antenna;

b) using said fractional phase shift values to determine an element delay value for each of said antenna elements, each said element delay value representing a delay in wavelengths required for a signal from a specific said antenna element to said center of said antenna in order to sum in-phase with signals from other ones of said antenna elements;

c) inputting said element delay values into an external beam steering controller associated with said antenna; and d) using said external beam steering controller to calculate actual phase shift values from said element delay values for each said antenna element in said antenna; wherein said antenna elements are non-uniformly spaced in the X, Y and Z dimensions.

9. The method of claim 8, wherein said fractional phase shift values are calculated as 16 bit binary values with a least significant bit (LSB) representing $2^{-10}$ of a wavelength at a center operating frequency of said antenna.

10. The method of claim 8, wherein step d) comprises truncating said element delay values to a whole wavelength.

* * * * *